US005267360A

United States Patent [19]

Bassil et al.

[11] Patent Number: 5,267,360

[45] Date of Patent: Dec. 7, 1993

[54] BATH LIFT

[75] Inventors: Rob Bassil, Leamington Spa; Gavin H. James, Ledbury, both of Great Britain

[73] Assignee: The Helping Hand Company (Ledbury) Limited, Gloucester, Great Britain

[21] Appl. No.: 790,439

[22] Filed: Nov. 12, 1991

[30] Foreign Application Priority Data

Nov. 15, 1990 [GB] United Kingdom ..... 9024882

[51] Int. Cl.[5] ..... A47K 3/12

[52] U.S. Cl. ..... 4/560.1; 4/565.1

[58] Field of Search ..... 4/560.1, 561.1, 562.1, 4/563.1, 564.1, 565.1, 566.1

[56] References Cited

U.S. PATENT DOCUMENTS

| | | | |
|---|---|---|---|
| 2,045,110 | 6/1936 | Spiess | 4/562.1 |
| 2,123,398 | 7/1938 | Bowers | 4/562.1 |
| 2,242,939 | 5/1941 | Buckel | 4/565.1 |
| 2,604,638 | 7/1952 | Furry | 4/565.1 |
| 2,624,053 | 1/1953 | Beckwith | 4/565.1 |
| 2,754,523 | 7/1956 | Bruckner et al. | 4/566.1 |
| 3,045,255 | 7/1962 | Pirtle et al. | 4/565.1 |
| 3,317,928 | 5/1967 | Root | 4/561.1 |
| 3,349,411 | 10/1967 | Eaton | 4/564.1 |
| 3,506,985 | 4/1970 | Lang | 5/81 R |
| 3,581,316 | 6/1971 | Petersen | 4/566.1 |
| 5,103,509 | 4/1992 | Richards | 4/564.1 |
| 5,168,585 | 12/1992 | Cox | 4/560.1 |

FOREIGN PATENT DOCUMENTS

| | | |
|---|---|---|
| 0090867 | 10/1983 | European Pat. Off. . |
| 3434663 | 4/1986 | Fed. Rep. of Germany . |

*Primary Examiner*—Henry J. Recla
*Assistant Examiner*—Robert M. Fetsuga
*Attorney, Agent, or Firm*—Collard & Roe

[57] ABSTRACT

A bath lift for lowering and raising invalids and disabled users into and out of a bath tub, having a frame with spaced opposite sides mounted on the bath tub. A shaft is rotatably mounted to each of the spaced opposite sides. A flexible cable is coupled to each of the shafts. The bath lift further includes a seat member having two sides and a rear. Each of the sides is coupled to one of the flexible cables, wherein rotation of either of the shafts effects a controlled movement of the corresponding side of the seat member. A back rest is pivotally connected to the rear of the seat member and is supported by the frame through a linkage. The linkage pivots the back rest as the seat member moves.

9 Claims, 5 Drawing Sheets

BATH LIFT

BACKGROUND OF THE INVENTION

1. Field of the Invention

The invention relates to bath lifts for raising or lowering invalids and disabled users out of or into a bath tub. It is particularly concerned with a bath lift which has a frame which mounts on the rim of a bath tub and a seat supported from the frame, the lift being operative to raise and lower the user in a seated position.

2. Description of the Prior Art

Such a bath lift is known comprising a seat member suspended from the frame on flexible supporting cables. The seat member is raised and lowered by a screw and nut operating mechanism the screw of which extends laterally at the end of the bath for manual operation, the cables being guided over pulleys from the nut of the mechanism. This known lift has significant disadvantages resulting from the lifting mechanism arrangement.

SUMMARY OF THE INVENTION

The invention has for its object to overcome at least some of the aforesaid disadvantages.

In a bath lift according to the invention two separately mounted shafts respectively extend along the sides of the frame, rotation of either shaft effecting controlled lifting (or lowering) of the corresponding side of a seat member suspended on flexible cables or tapes.

The frame is preferably adjustable in width to suit the bath tub at the time in use, the provision of such adjustment being facilitated by the separate side shafts of the invention. A further advantage of the separate shafts is that adjustment of the level of the seat member is more easily effected as the two sides thereof are independently suspended.

Preferably the cables or tapes are wound directly on to the respective side shafts, windlass-fashion, and they are conveniently webbing tapes. However, the words "cables or tapes" as used herein are to be construed broadly as including any elongate flexible members usable to suspend the seat member for the purposes of the invention.

The two shafts may be independently driven by respective geared electric motors, with a control circuit which maintains the rotational movements of the shafts in step so that the seat member remains horizontal during raising and lowering movement. Control of the motors may be dependent on a stepping count of shaft angular movement, this preferably being sensed at the output shaft of each drive motor gearing.

The fully-raised position of the seat member may be determined by the decrease in motor speed as the lifting tapes become taut, and to this end the control circuit may sense a speed decrease to a predetermined minimum value. As a correcting feature to compensate for tape stretching, etc. the control circuit may commence the stepping count of each shaft at the fully-lowered position when the seat member is resting at the bottom of the bath tub, which thus provides the control datum position.

Each suspension cable or tape which supports the seat member during raising and lowering movement thereof is preferably one of a pair the other of which is connected to the seat member and is slack at all positions other than the fully-raised position, with the two tapes effectively acting at different levels on the seat member. Thus when the lift is fully raised both tapes of each pair are taut, so that triangulated tension support of the seat member holds it firmly located not only heightwise but also laterally and longitudinally of the bath tub.

Side flaps may be fixed along the side edges of the seat member so as to drop down at the fully-raised position to extend over the respective shafts. This makes it easy for a user to slide on to, and off, the seat member from the side over either of the so-covered shafts. The shafts may, alternatively, be shrouded for the same purpose, for example housed within hollow side arms of the frame.

A back rest may be provided associated with the seat member and which has an inclination dependent on the height position of the seat member. This back rest may be hinged to the rear of the seat member and connected through a linkage to the frame of the bath lift, the linkage being operative to provide the desired control of the inclination of back rest as the seat member is raised or lowered. A head rest may also be provided, fixed at the rear of the frame which may also house the complete lifting mechanism, control circuit and energizing batteries to power the lift.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be made as desired by those skilled in the art without departing from the present invention and the purview of the appended claims.

BRIEF DESCRIPTION OF THE DRAWINGS

The accompanying drawings illustrate, by way of example, two embodiments of bath lift in accordance with the invention. In the drawings.

DESCRIPTION OF THE PREFERRED EMBODIMENTS

Figure 1:
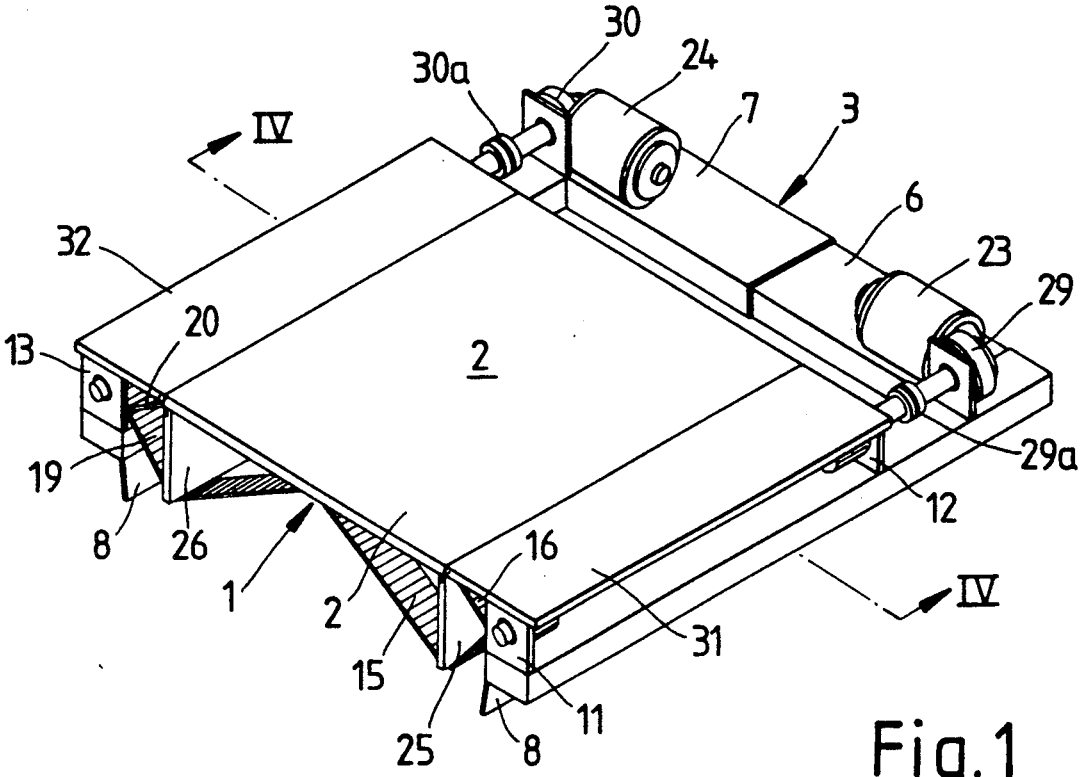
FIGS. 1 to 3 illustrate diagrammatically and in perspective view the basic structure of one bath lift in accordance with the invention, respectively showing a seat member in fully-raised, intermediate and fully-lowered height positions.

The bath lift illustrated in FIGS. 1 to 4 has a seat assembly 1 including a seat member 2 of rectangular shape, shown in the drawings by way of example as a flat board whereas in practice it will normally be contoured or otherwise formed to provide more comfortable seating for the user. The seat member 2 is suspended from the side arms of a U-shaped frame 3 which sits on the rim 4 of the bath tub 5 at the head end of the latter. The frame 3 comprises two L-shaped sections 6 and 7 which, at the base of the frame U, fit slidably one within the other for telescopic width adjustment of the frame 3 to suit the bath tub 5 with which the lift is at the time being used. Each frame section 6 or 7 has two spaced locator plates 8 which engage within the bath tub rim 4 for lateral location of the frame 3, as is clearly shown in FIG. 4.

Locking means (not illustrated) are provided to lock the frame members 6,7 together at the adjusted frame width. Parallel winding shafts 9 and 10 are rotatably mounted on the frame members 6 and 7, in bearings in spaced support brackets 11,12 and 13,14 respectively, these shafts running along the side limbs of the frame U. The seat assembly 1 is suspended at the four corners of the seat member 2, from the side shafts 9 and 10, by webbing tapes. These tapes are wound in pairs 15,16 and 17,18 on the shaft 9 and pairs 19,20 and 21,22 on the shaft 10, the shafts respectively being turned by individual reversible electric motors 23 and 24 to raise and lower the seat assembly 1 windlass-fashion. The frame members 6 and 7 include tape guides, respectively **6*a* and 7*a***, with guide slots through which the tapes pass and which thus maintain the overlying paired tape relationships.

The seat assembly 1 includes bottom hinged plates 25 and 26 which are freely hinged along the opposite side edges of the seat member 2. The outer webbing tapes 15 and 17 are secured to the bottom edge of the side plate 25, as by pins such as 27 (FIG. 2), and continue around and below the plate 25 to be secured at the centre of the seat member 2 at 28. Similarly, the outer webbing tapes 19 and 21 are secured to the side plate 26 at the bottom edge thereof and to the seat member 2 at the centre 28. The result is that in a suspended, i.e. partially-lowered, position of the seat assembly 1 the lower end portions of the tapes 15,17,19,21 are taut to define slightly inwardly inclined positions of the side plates 25 and 26. This condition is illustrated in FIG. 2, the side plates 25 and 26 thus acting as struts through which the seat member 2 is supported during raising and lowering movement by the tapes 15,17,19,21 with the inner tapes 16,18,20,22 at this time slack.

Figure 3:
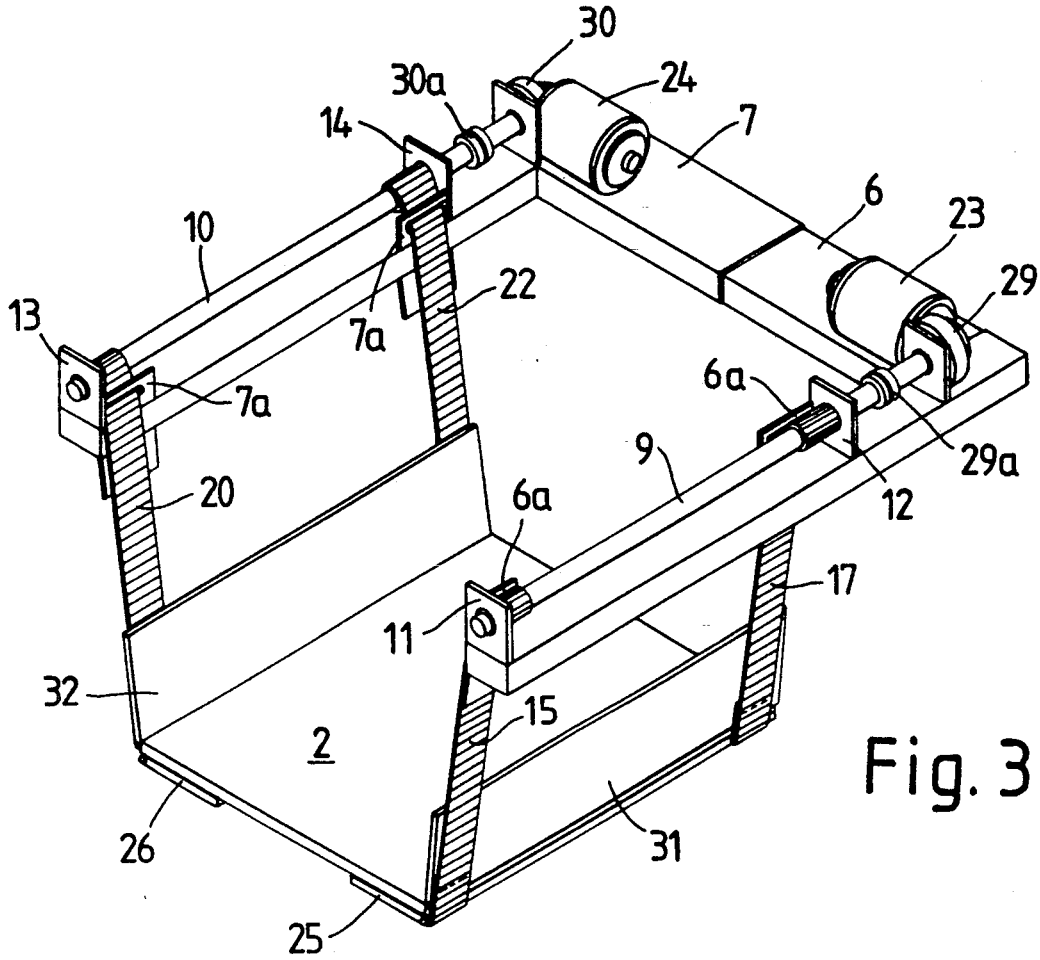

As the seat assembly 1 reaches the bottom of the bath tub the side plates (struts) 25 and 26 are engaged by the side walls **5*a* and 5*b* of the bath tub 5 with a camming action so that they deflect inwardly and fold up beneath the seat member 2. At the fully-lowered position, as illustrated in FIG. 3 and shown in broken lines in FIG. 4, the plates 25 and 26 lie flat against the bottom 5*c* of the tub 5** and the user can bathe, or be bathed, immersed in the bath water.

Figure 2:
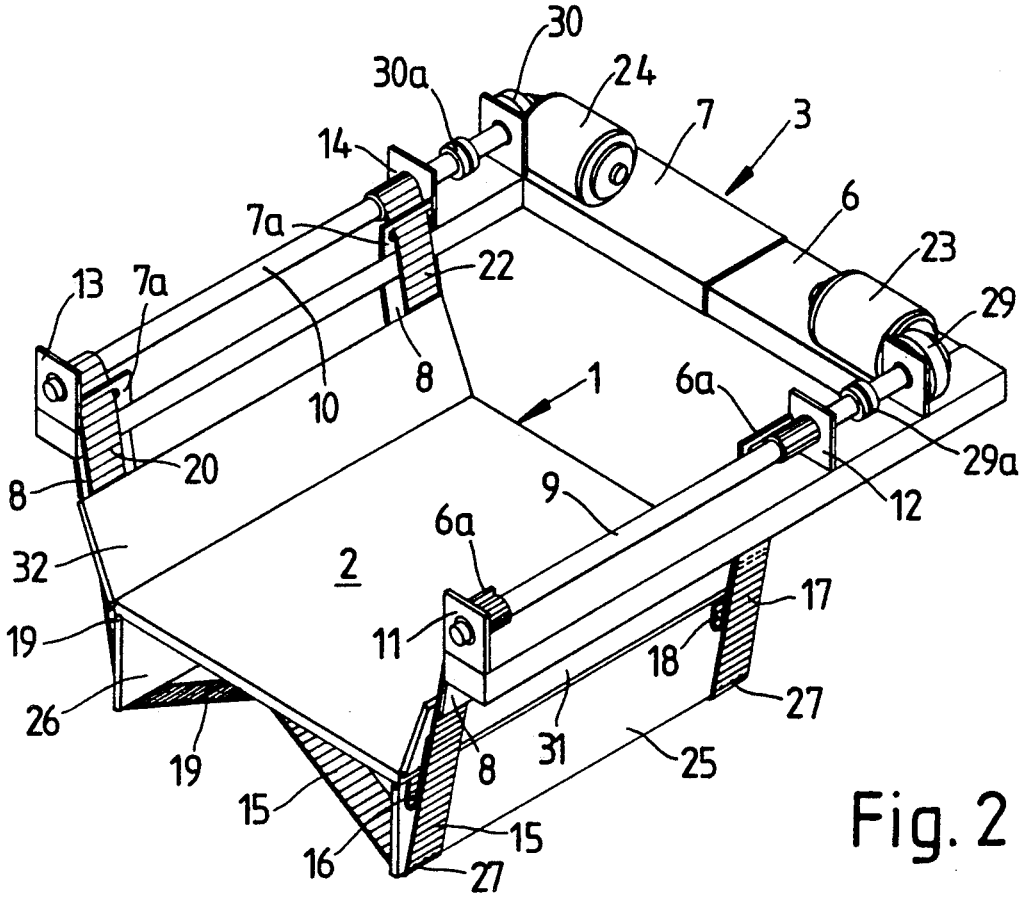

Turning of the shafts 9 and 10 in the appropriate contra-directions by the motors 23 and 24, respectively, raises the seat assembly 1 with the side plates extending back to the FIG. 2 intermediate-height position condition as the assembly 1 clears the tub bottom **5*c*. The motors 23 and 24 are coupled to the shafts 9 and 10 through right-angle reduction gearings 29 and 30 which, being irreversible in the drive sense, effectively lock the shafts 9 and 10 at any height position of the seat assembly 1 and, in particular, produce controlled lowering movement as the suspended weight cannot "run away" with the drive and braking mechanisms are not required. The final drive to the shafts 9 and 10 is through flexible couplings 29*a* and 30*a***, respectively.

Figure 4:
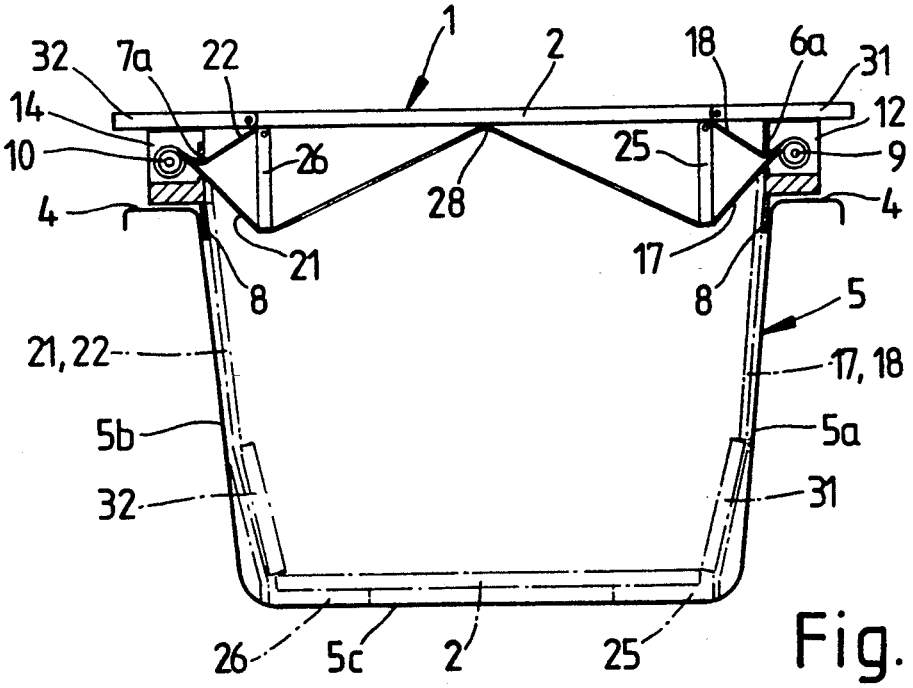
FIG. 4 is a cross-sectional view on the line IV—IV in FIG. 1.
Figure 5:
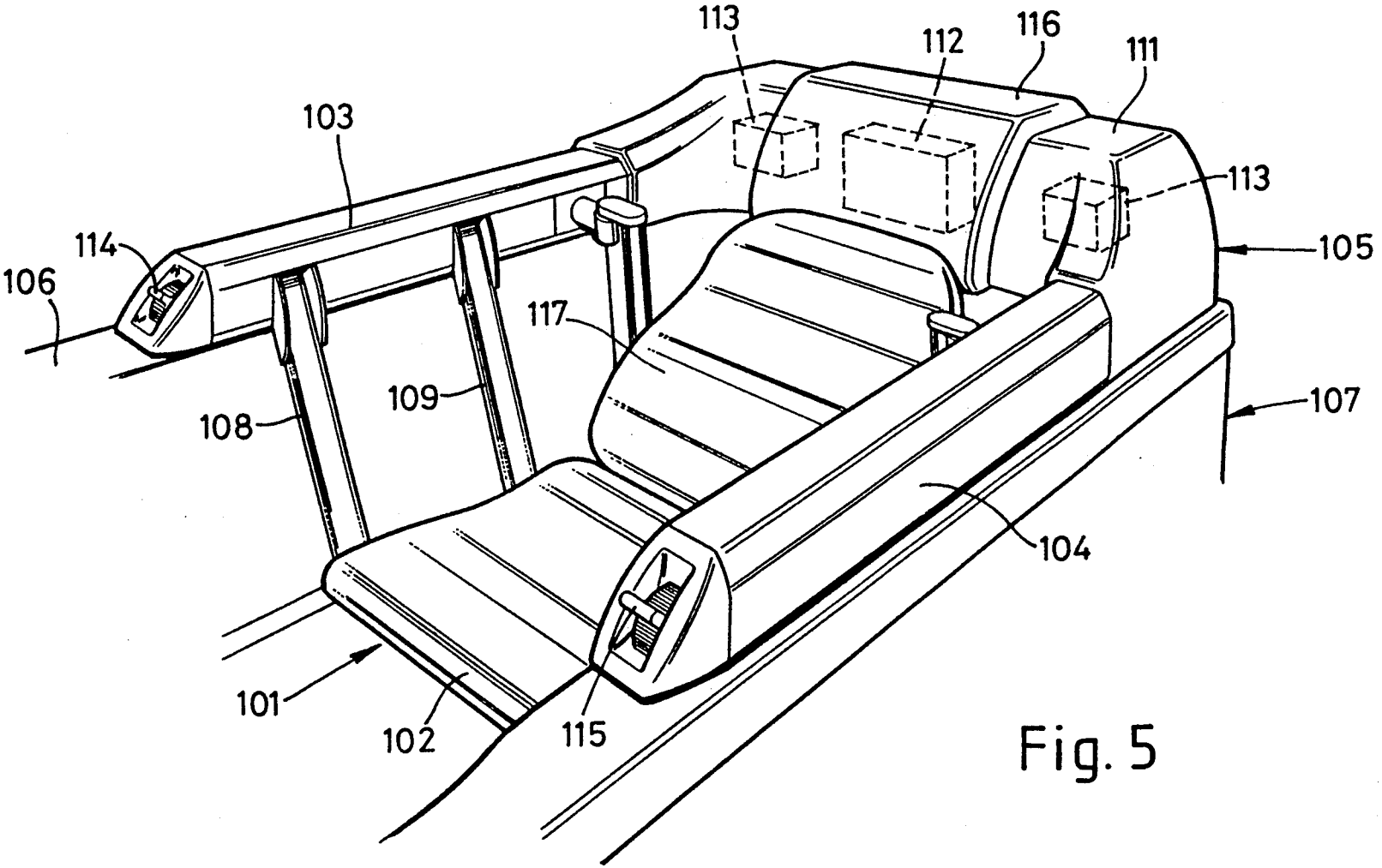
FIG. 5 is a perspective view of a second embodiment.

Side flaps 31 and 32 are also freely hinged along the opposite side edges of the seat member 2, so that at intermediate- and fully-lowered height positions these flaps rest against the respective side supporting tapes. However, as the assembly 1 reaches the fully-raised position the seat member 2, due to the provision of the side plates 25 and 26, is lifted above the bath rim 4 by the tapes 15, 17, 19 and 21 and the flaps 31 and 32, as shown in FIGS. 1 and 4, drop down until they lie level with the seat member 2 and rest on the support brackets 11 and 12, or 13 and 14, respectively. Thus a seating surface is provided above the height of the of the bath tub 5, on to and off which the user can slide or be slid. This makes the bath lift especially suitable for access to and from the bath by a wheelchair user. As mentioned this advantage results from the provision of the side plates which enable the seat member 2 to be raised above the height of the tub 5 whilst, being hinged, they fold up beneath the seat member 2 and thus do not substantially restrict the usable depth of the tub 5.

As the fully-raised seat position is approached the inner webbing tapes 16,18,20,22 also go taut and thus, when the seat assembly 1 is fully raised, all the tapes are taut and the seat assembly is firmly suspended between the shafts 9 and 10. As FIG. 4 makes clear a triangulated tension supporting arrangement results, at each side of the seat member 2, from the provision of the webbing pairs and the side plates 25 and 26. Thus the seat assembly is firmly and rigidly held and located centrally of the bath tub 5 whilst the user slides on to and off the seat member 2.

The individual shaft-drive motors 23 and 24 are controlled by a low-voltage control circuit (not illustrated) which has control switches accessible to the user for self operation. This control circuit is servo-controlled, so that the two motors remain in step, and the full-raised position is determined by decrease in motor speed to a minimum value as all four webbing tapes become taut. This position is determined by the control circuit which senses the predetermined minimum value of motor speed. The control circuit incorporates rotation measuring means to compare rotation of the shafts, the rotation measurement starting during each cycle of lifting operation at the fully-lowered position. Thus at each cycle of operation any necessary corrective action is taken to compensate, for example, for differential stretching of the webbing tapes. Rotation measurement is effected by a stepwise count of angular movement, for each shaft the count being effected at the output shaft of the corresponding drive gearing.

The embodiment of the invention illustrated in FIGS. 5 to 9 is functionally similar to that already described. Thus a seat assembly 101, which includes a contoured seat member 102, is suspended from the side arms 103,104 of a U-shaped frame 105 which sits on the rim 106 of the bath tub 107. As before the seat member 102 is suspended from rotatable side shafts housed and fully shrouded within the side arms 103,104 which are hollow for this purpose. The suspension is via webbing tape pairs such as 108,109 as previously described.

The lifting mechanism is also completely housed within the hollow frame 105 which has a rear member 111 in which the control circuit 112 which functions as previously described, and two rechargeable batteries 113, are housed. The batteries 113 energise the control circuit and power the lift. "Up" and "Down" control switches 114 and 115 are conveniently positioned at the outer ends of the side arms 103 and 104 for self-operation of the lift by a user seated on the seat member 102.

The rear member 105 is again telescopic for adjustment of the frame 105 to suit the width of the bath tub 107 with which the bath lift is at the time being used. Not only are both illustrated lifts thus adaptable to fit different bath tubs, but they can readily be removed from the bath tub when not required to allow unimpeded bathing by non-disabled users. A padded head rest 116 is fixed on the rear frame member 111.

In this embodiment the seat assembly 101 also includes a back rest 117 which has a variable inclination, which is controlled automatically in dependence on the height of the seat member 102. To this end the back rest 117 is attached to the seat member 102 and also supported from the frame 105.

Referring particularly to the diagrammatic views of FIGS. 6 to 9, the back rest 117 is hinged to the rear of the seat member 102 at 118. It is also supported from the frame 105 by a linkage 119 which, at each side of the back rest 117, comprises a Siamese double-tubular guide member 121 the cross-section of which is shown as an enlarged detail in FIG. 9. One tubular section 121*a* of the guide member 121 provides a guide for a slide member 122 which is pivotally supported at a fixed position on the inner side of the corresponding side arm 103 or 104. The other tubular section of the guide member 121 provides a guide for a slide member 123 which is pivotally mounted at the corresponding end of a support rod 124 which is fixed laterally of and behind the back rest 117.

Figure 6:
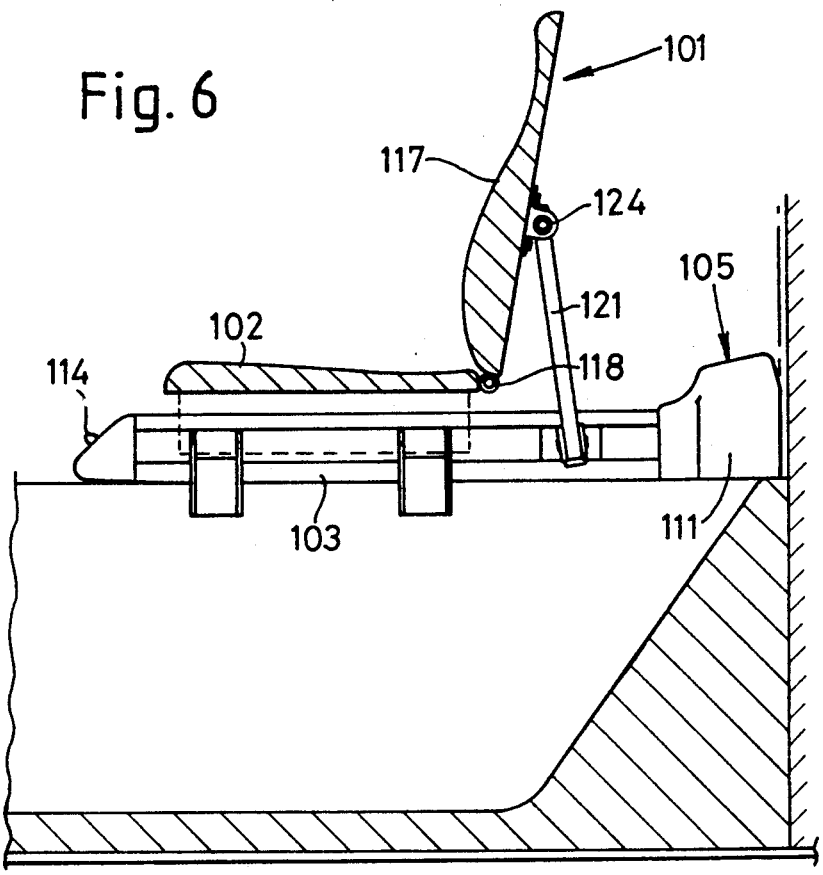
FIGS. 6 and 7 are respectively diagrammatic side and front views illustrating support of a back rest in the fully-raised position.
Figure 7:
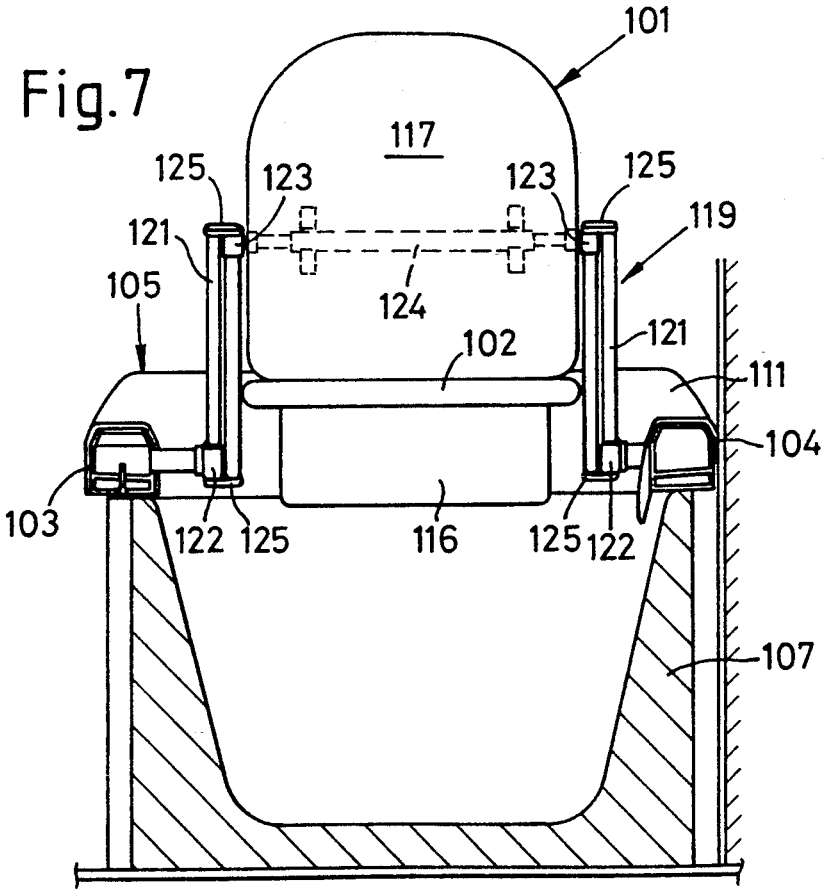
Figure 8:
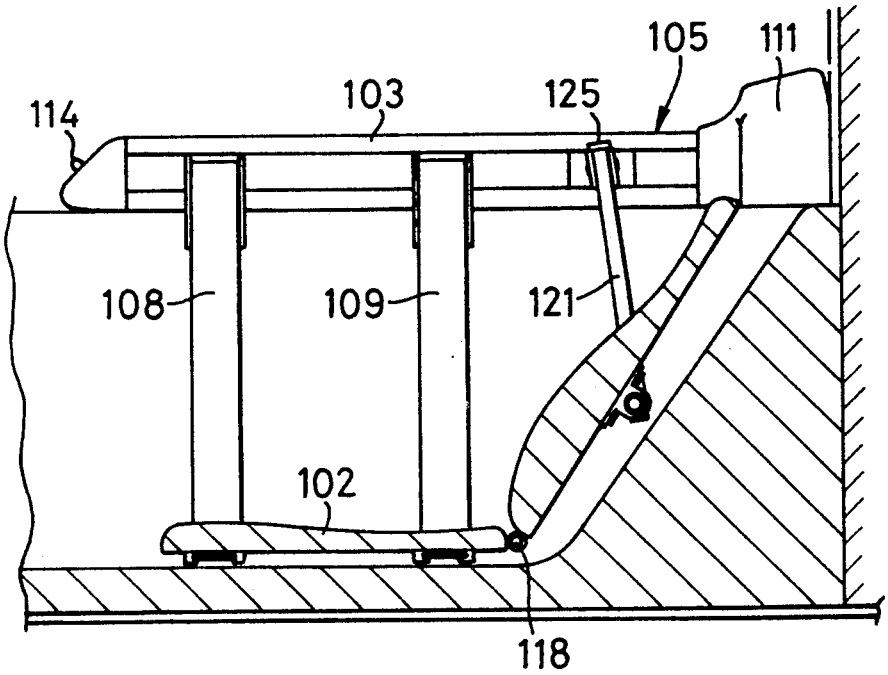
FIGS. 8 and 9 are similar views illustrating support in the fully-lowered position.
Figure 9:
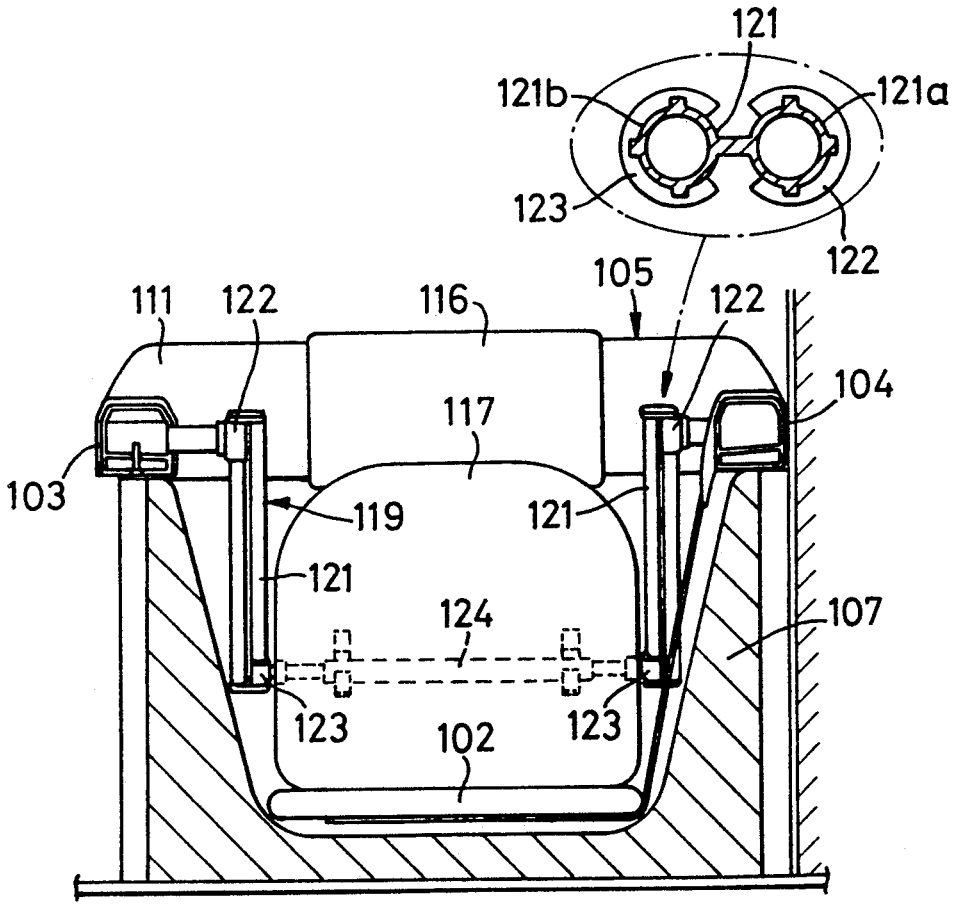

The slide members 122,123 slide freely on the guide member 121, in each case sliding movement being limited by end stops 125 on the member 121. The result of this linkage support is that in the fully-raised position (as shown in FIGS. 6 and 7) the members 121 extend upwardly from the frame 105 and support the back rest 117 in a generally upright position for support of a seated user. When in the fully-lowered position (as shown in FIGS. 8 and 9) the members 121 extend downwardly from the frame 105 into the bath tub 107 with the back rest 117 at a backward inclination for comfortable to support of a reclining user with head on the head rest 116. During raising and lowering movement of the seat assembly 101 the inclination of the back rest 117 varies smoothly between these two illustrated limit positions.

What is claimed is:

1. A bath lift for lowering and raising invalids and disabled users into and out of a bathtub, comprising:

a frame having spaced opposite sides adapted to be mounted on the bathtub;

a shaft rotatably mounted to each of said spaced opposite sides;

a flexible cable coupled to each of said shafts;

a seat member having two sides and a rear, each of said sides being coupled to a corresponding one of said flexible cables, wherein rotation of either of said shafts effects a controlled movement of the corresponding side of said seat member; and a back rest and a linkage, said back rest being pivotally connected to said rear of said seat member and supported by said frame through said linkage, wherein said linkage pivots said back rest as said seat member moves.

2. The bath lift according to claim 1, wherein said frame has an adjusting mechanism for adjusting to the framewidth to the size of the bathtub.

3. The bath lift according to claim 1, wherein said flexible cables are wound directly onto the corresponding shafts.

4. The bath lift according to claim 3, wherein said flexible cables are webbed cables.

5. The bath lift according to claim 1, additionally including a pair of flexible cables coupled between each of said shafts and the corresponding side of said seat member, said seat member including a fully-raised position wherein one cable of each pair is slack at all positions other than said fully-raised position.

6. The bath lift according to claim 1, wherein said frame includes spaced opposite, hollow side arms, said shafts being rotatably mounted within said spaced opposite, hollow side arms.

7. A bath lift for lowering and raising invalids and disabled users into and out of a bathtub, comprising:

a frame having spaced opposite sides and a rear member, adapted to be mounted on the bathtub;

a shaft rotatably mounted to each of said spaced opposite sides;

a control circuit, batteries and a lifting mechanism operatively coupled to rotate said shafts;

a hollow head rest attached to said rear member of said frame and housing said control circuit;

a flexible cable coupled to each of said shafts;

a seat member having two sides, each said of said sides being coupled to a corresponding one of said flexible cables, wherein rotation of either of said shafts effects a controlled movement of the corresponding side of said seat member.

8. The bath lift according to claim 7, wherein said lifting mechanism includes geared electric motors for independently rotating said shafts, said control circuit controls the rotational movements of said shafts so that said seat member remains substantially horizontal during movement.

9. A bath lift for lowering and raising invalids and disabled users into and out of a bathtub, comprising:

a frame having spaced opposite sides and a rear member, mounted on the bathtub;

a shaft rotatably mounted to each of said spaced opposite sides;

a flexible cable coupled to each of said shafts;

a seat member having two sides, each of said sides being coupled to a corresponding one of said flexible cables;

moving mechanism coupled to said shafts for rotating said shafts, wherein rotation of either of said shafts affects a controlled movement of the corresponding side of said seat member;

a control circuit including batteries coupled to said moving mechanism for controlling said moving mechanism to selectively raise and lower said seat member; and a hollow head rest attached to said rear member of said frame and housing said control circuit.

* * * * *